US006031174A

United States Patent [19]

Takabayashi

[11] Patent Number: 6,031,174

[45] Date of Patent: Feb. 29, 2000

[54] GENERATION OF MUSICAL TONE SIGNALS BY THE PHRASE

[75] Inventor: Youjiro Takabayashi, Hamamatsu, Japan

[73] Assignee: Yamaha Corporation, Hamamatsu, Japan

[21] Appl. No.: 09/159,113

[22] Filed: Sep. 23, 1998

[30] Foreign Application Priority Data

Sep. 24, 1997 [JP] Japan ..... 9-259004
Dec. 17, 1997 [JP] Japan ..... 9-348165

[51] Int. Cl.[7] ..... A63H 5/00; G04B 13/00; G10H 7/00

[52] U.S. Cl. ..... 84/609; 84/615

[58] Field of Search ..... 84/609, 610, 615, 84/634, 653

[56] References Cited

U.S. PATENT DOCUMENTS 5,355,762 10/1994 Tabata ..... 84/609
5,399,799 3/1995 Gabriel ..... 84/609
5,763,804 6/1998 Rigopulos et al. ..... 84/609 X

FOREIGN PATENT DOCUMENTS 58-14187 1/1983 Japan .

*Primary Examiner*—Jeffrey Donels
*Attorney, Agent, or Firm*—Graham & James LLP

[57] ABSTRACT

A method of generating a musical tone signal having the steps of selecting one of a plurality of phrases in response to manipulation of a phrase select operator by a user, and reading performance data of the selected phrase from performance data pre-stored by the phrase to generate a musical tone signal of the read performance data.

34 Claims, 13 Drawing Sheets

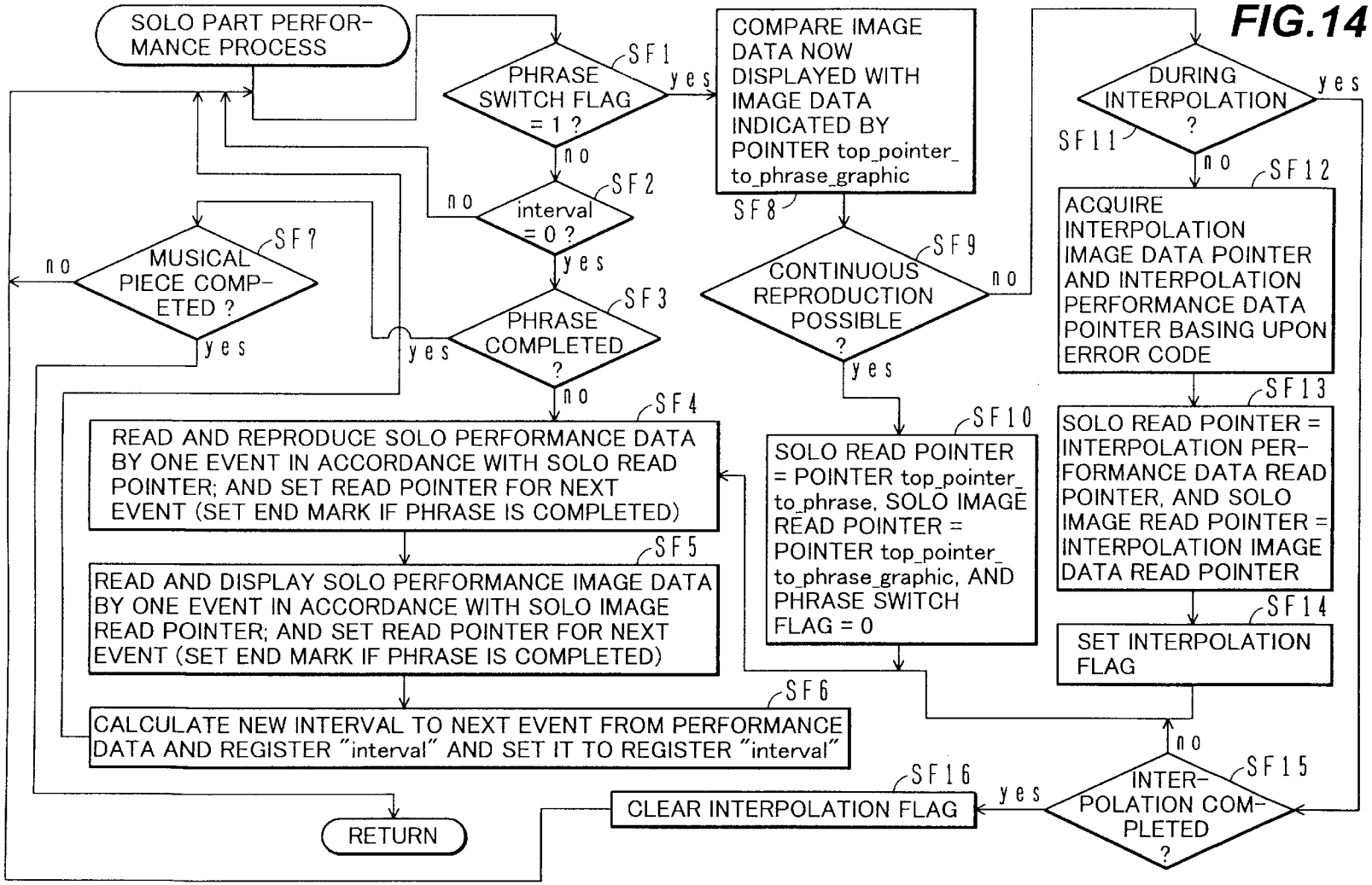
FIG.14
SOLO PART PERFORMANCE PROCESS
PHRASE SWITCH FLAG = 1 ?
SF1
yes
no
COMPARE IMAGE DATA NOW DISPLAYED WITH IMAGE DATA INDICATED BY POINTER top_pointer_to_phrase_graphic
SF8
interval = 0 ?
SF2
yes
no
PHRASE COMPLETED ?
SF3
yes
no
CONTINUOUS REPRODUCTION POSSIBLE ?
SF9
yes
no
SOLO READ POINTER = POINTER top_pointer_to_phrase, SOLO IMAGE READ POINTER = POINTER top_pointer_to_phrase_graphic, AND PHRASE SWITCH FLAG = 0
SF10
READ AND REPRODUCE SOLO PERFORMANCE DATA BY ONE EVENT IN ACCORDANCE WITH SOLO READ POINTER; AND SET READ POINTER FOR NEXT EVENT (SET END MARK IF PHRASE IS COMPLETED)
SF4
READ AND DISPLAY SOLO PERFORMANCE IMAGE DATA BY ONE EVENT IN ACCORDANCE WITH SOLO IMAGE READ POINTER; AND SET READ POINTER FOR NEXT EVENT (SET END MARK IF PHRASE IS COMPLETED)
SF5
CALCULATE NEW INTERVAL TO NEXT EVENT FROM PERFORMANCE DATA AND REGISTER "interval" AND SET IT TO REGISTER "interval"
SF6
MUSICAL PIECE COMPETED ?
SF7
yes
no
RETURN
DURING INTERPOLATION ?
SF11
yes
no
ACQUIRE INTERPOLATION IMAGE DATA POINTER AND INTERPOLATION PERFORMANCE DATA POINTER BASING UPON ERROR CODE
SF12
SOLO READ POINTER = INTERPOLATION PERFORMANCE DATA READ POINTER, AND SOLO IMAGE READ POINTER = INTERPOLATION IMAGE DATA READ POINTER
SF13
SET INTERPOLATION FLAG
SF14
INTERPOLATION COMPLETED ?
SF15
no
yes
CLEAR INTERPOLATION FLAG
SF16

GENERATION OF MUSICAL TONE SIGNALS BY THE PHRASE

BACKGROUND OF THE INVENTION a) Field of the Invention

The present invention relates to techniques of generating musical tone signals, and more particularly to techniques of generating musical tone signals in response to manipulations entered by a user.

b) Description of the Related Art

An electronic musical instrument having an automatic accompaniment function automatically gives a player musical accompaniment in accordance with the type of accompaniment designated by the player. The player can operate upon keys and play melody parts while being given automatic accompaniment. By using the automatic accompaniment function, the player is not required to perform accompaniment parts and can easily play in concert only by giving melody parts.

It is difficult for a novice player even to give melody parts. Musical performance techniques are requested more or less in order to depress keys in accordance with notes on a staff. In order for a player to become accustomed with key depressions, a predetermined set of lessons is generally necessary. An electronic musical instrument with which novices can play in concert has been desired to date.

With an automatic accompaniment function, it is difficult for a plurality of players to play in concert, such as band musical performance. A concert can be performed by interconnecting electronic musical instruments with MIDI cables. However, a system becomes large and cost becomes high.

Various types of game machines are prevailing with high popularity. A game machine has as its operator a game pad. A user manipulates the game pad to enjoy various games. If a concert can be performed with game pads, it is convenient and inexpensive for users.

As compared with a keyboard, the game pad has a considerably small number of keys. For example, a keyboard has 64 or 88 keys, volume keys, tone color select keys and the like. A game pad has about ten keys at most. Since the number of operation keys of a game pad is small, it is difficult to make a musical performance with the game pad.

SUMMARY OF THE INVENTION

It is an object of the present invention to provide a musical tone signal generating method and apparatus capable of making a musical performance with simple operations, and to provide a storage medium storing programs for realizing such a musical tone signal generating method.

According to one aspect of the present invention, there is provided a method of generating a musical tone signal, comprising the steps of: (a) selecting one of a plurality of phrases in response to manipulation of a phrase select operator by a user; and (b) reading performance data of the selected phrase from performance data pre-stored in unit of phrase and generating a musical tone signal of the read performance data.

Users can improvise musical performance with ease only by selectively switching between phrases with game pads. Since a phrase composed of a plurality of sounds is selected, it is sufficient even if an operation speed of a user is slow. Since each phrase of a musical piece is assigned characteristics specific to the musical piece, even a novice can select phrases matching the progression of the musical piece. As compared to a number of depression operations of a keyboard, a musical performance can be made with simple operations. Even a novice without knowledge of musical instruments and music can play music with simple operations.

BRIEF DESCRIPTION OF THE DRAWINGS

FIG. 14 is a flow chart illustrating a solo performance process.

DETAILED DESCRIPTION OF THE PREFERRED EMBODIMENTS

Figure 1:
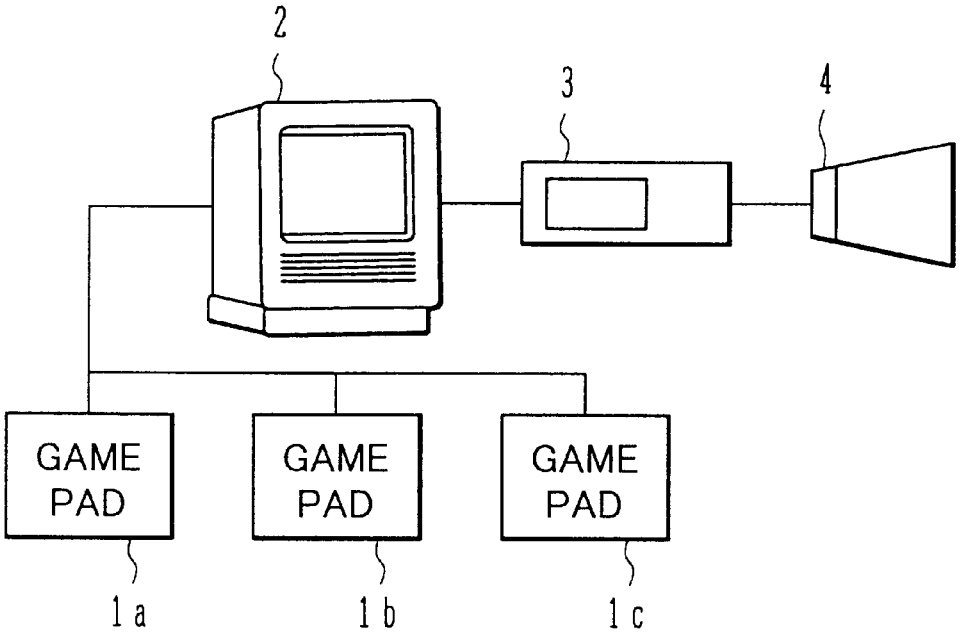
FIG. 1 is a schematic diagram showing the structure of a tone signal generating apparatus according to an embodiment of the invention.

FIG. 1 shows the structure of a musical tone signal generating apparatus according to an embodiment of the invention.

The musical tone signal generating apparatus has three game pads 1*a,* 1*b* and 1*c,* a computer 2, a sound generator (tone generator) 3, and a speaker 4. Each or all of the game pads 1*a,* 1*b* and 1*c* are collectively called a game pad 1 where applicable.

The game pad 1 has operation keys for a user to make a musical performance or enter musical performance settings. By operating upon the game pad 1, the user can make a desired musical performance. Although three game pads 1*a,* 1*b* and 1*c* are connected to the computer 3, the number of game pads 1 is not limited but four or more, two or less, or only one game pad may be used.

For example, with the three game pads 1*a,* 1*b* and 1*c,* three users can play in concert, each being assigned one game pad.

The tone signal generating apparatus can make a band performance. The band performance can be classified into a back performance and a solo performance. For example, the back performance corresponds to rhythm parts such as drums and bases, and the solo performance corresponds to melody parts such as guitars, saxophones and keyboards.

The back performance is automatically made by the computer 2, whereas the solo performance is made by users operating upon the game pads 1. Each game pad 1 may be assigned a desired solo performance musical instrument. For example, the game pad 1*a* may be assigned a guitar, the game pad 1*b* may be assigned a saxophone, and the game pad 1*c* may be assigned a keyboard.

A user can select a character of the musical instrument by using a musical instrument select operator or a character select operator. For example, the character includes a first guitar, a second guitar, a male player, and a female player. A user can select the musical instrument or character with the musical instrument select operator or character select operator.

The computer 2 stores performance data of, e.g., 24 phrases for each musical instrument and character. The user selects a desired phrase number from the 24 phrases with the game pad 1. As the user selects the phrase number, the phrase corresponding to the selected phrase number is played in real time. A user can make a desired impromptu performance only by designating a sequence of phrases and a start timing of each phrase. The phrase is a part of a musical piece and a collection of a plurality of sounds, constituting a melody or a musical tone group irrespective of a length it has.

The computer 2 outputs back performance musical tone parameters by using automatic performance techniques, and outputs solo performance musical tone parameters in accordance with manipulations of the game pads 1. These musical tone parameters are supplied to the sound generator 3. The back performance is automatically made, and the solo performance is given by each user.

Each user can give some effects (such as pitchbend) to each musical tone with the game pad 1. The computer 2 supplies the effect parameter to the sound generator 3 in accordance with the manipulation of the game pad 1.

For example, the sound generator 3 is a PCM sound generator, an FM sound generator, a physical model sound generator, a formant sound generator or the like. The sound generator 3 generates musical tone signals in accordance with the musical tone parameters and effect parameters. The musical tone signals are supplied to the speaker 4.

The speaker 4 reproduces a sound in accordance with an analog musical tone signal converted from a digital musical tone signal. Back performance and solo performance are given in concert and reproduced from the speaker 4.

Figure 2:
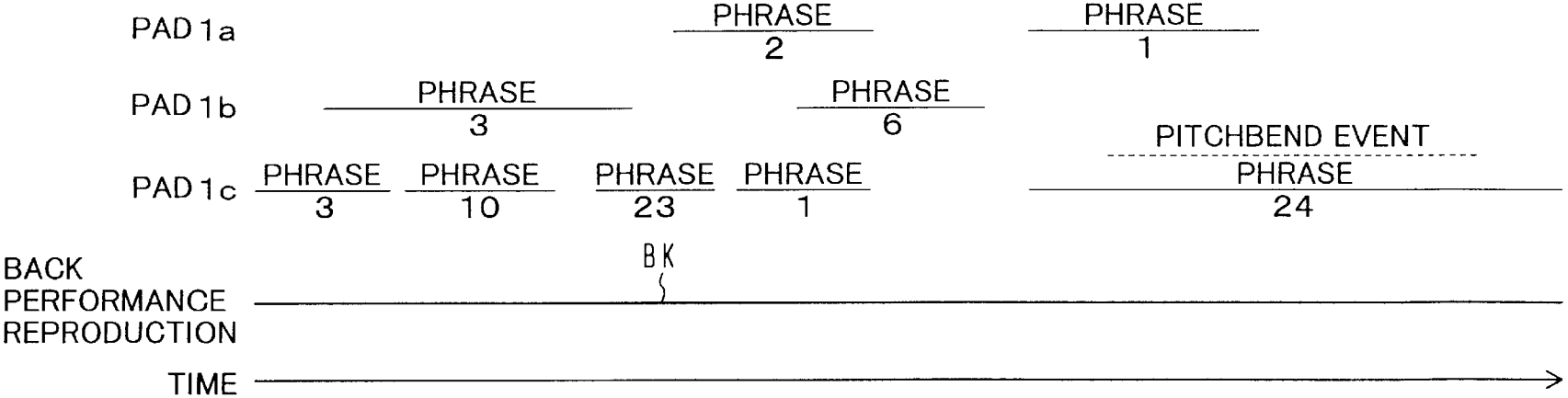
FIG. 2 is a timing chart illustrating an example of tone signal generation.

FIG. 2 illustrates an example of a musical performance made by using the musical tone generating apparatus according to the embodiment. The abscissa represents time.

The back performance BK starts when a user designates a reproduction start of a musical piece, and progresses independently from the manipulation of the game pads 1.

In the example shown in FIG. 2, a first user designates reproduction of a phrase "2" with the game pad 1*a* when a predetermined time lapses, and thereafter designates reproduction of a phrase "1". In this case, the user can change the pitch by generating a pitchbend event with the game pad 1*a*.

A second user designates reproduction of a phrase "3" with the game pad 1*b*, and thereafter designates reproduction of a phrase "6".

A third user sequentially designates phrases "3", "10", "23", "1", and "24" with the game pad 1*c*. When the phrase "24" is reproduced, the user issues the pitchbend event by using the game pad 1*c* and changes the pitch of the phrase "24".

As above, each user can make a musical performance only by designating the phrase numbers and phrase start timings.

Figure 3:
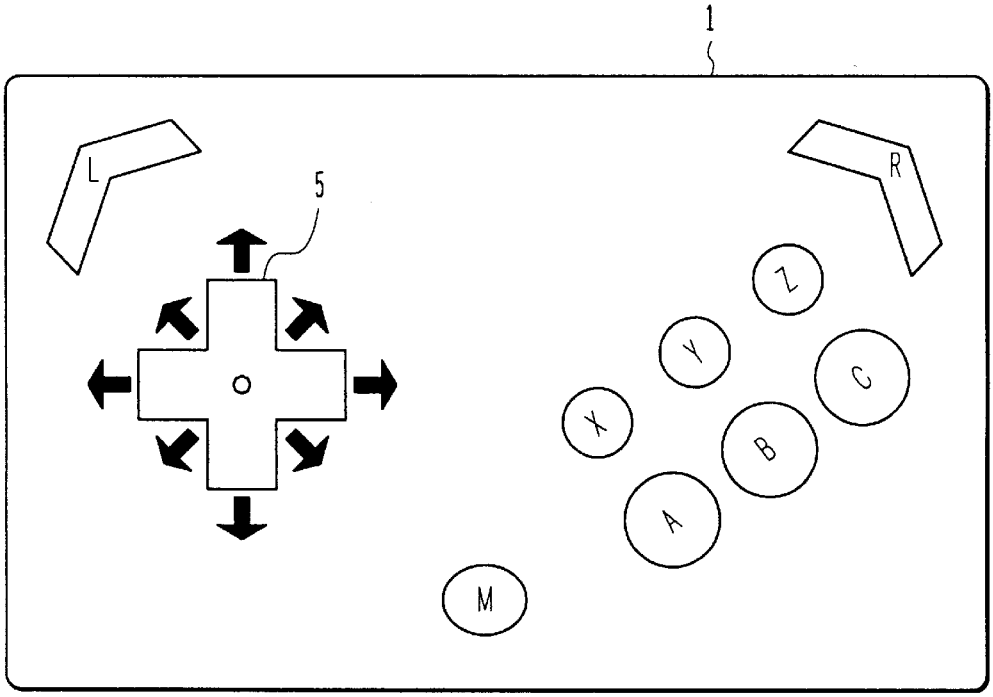
FIG. 3 is a front view of a game pad showing the layout of game pad buttons.

FIG. 3 shows operation buttons of the game pad 1.

The game pad 1 has "L", "R", "M", "A", "B", "C", "X", "Y", and "Z" buttons and a direction key 5.

First, a method of designating a phrase number in a performance mode will be described. Phrases "1" to "24" are classified into four types.

Phrases "1" to "6" are first musical piece phrases, and phrases "7" to "12" are second musical piece phrases. The musical piece phrases are necessary for composing a musical piece. Phrases 13 to 18 are first performance style phrases, and phrases "19" to "24" are second performance style phrases. The performance style phrases are phrases designating performance styles specific to musical instruments, such as code cutting.

In order to designate the phrases "1" to "6", the button shown in the following Table 1 is depressed without depressing both the "L" and "R" buttons. The first musical piece phrases "1" to "6" are relatively short and simple phrases.

In order to designate the phrases "7" to "12", the button shown in Table 1 is depressed while the "L" button is depressed. The second musical piece phrases "7" to "12" are relatively long and complicated phrases.

In order to designate the phrases "13" to "18", the button shown in Table 1 is depressed while the "R" button is depressed. The first performance style phrases "13" to "18" are fundamental performance style phrases, for example, code cutting, arpeggio, and mute cutting, respectively of chord playing styles of a guitar.

In order to designate the phrases "19" to "24", the button shown in Table 1 is depressed while both the "L" and "R" buttons are depressed. The second performance style phrases "19" to "24" are specific performance style phrases, for example, slide down/up, tremolo arm, and harmonics.

TABLE 1

| Designated Phrase Number | Depressed Button |
|---|---|
| Phrases: "1", "7", "13", "19" | "A" Button |
| Phrases: "2", "8", "14", "20" | "B" Button |
| Phrases: "3", "9", "15", "21" | "C" Button |
| Phrases: "4", "10", "16", "22" | "X" Button |
| Phrases: "5", "11", "17", "23" | "Y" Button |
| Phrases: "6", "12", "18", "24" | "Z" Button |

The direction key 5 is a cross-shape key and can designate eight directions. By manipulating the direction key in the performance mode, effects can be added to a musical tone as shown in the following Table 2. As the direction key 5 is operated to designate an up-direction, the pitchbend can set in such a manner that the pitch is raised, whereas as it is operated to designate a down-direction, the pitchbend can be set in such a manner that the pitch is lowered. As the direction key 5 is operated to designate a right direction, a tempo can be raised, whereas as it is operated to designate a left direction, the tempo can be lowered. Instead of the pitchbend and tempo, a volume or a sound image orientation (panning) may also be changed.

The function of the direction key 5 may be automatically set in accordance with a musical instrument and character selected by a user.

TABLE 2

| Kinds of Effects | Depressed Key |
|---|---|
| Pitchbend Up | "↑" Key |
| Pitchbend Down | "↓" Key |
| Tempo Up | "→" Key |
| Tempo Down | "←" Key |

The "M" button is a mode change button for designating a performance mode, an initial setting mode and the like. The functions of other buttons may be changed in accordance with each mode. In the initial setting mode, the musical instrument or character may be selected by using the musical instrument select operator or character select operator.

As a user depresses the "M" button, a back performance can be automatically started. As a user designates a phrase, a solo performance of the phrase can be started.

Figure 4:
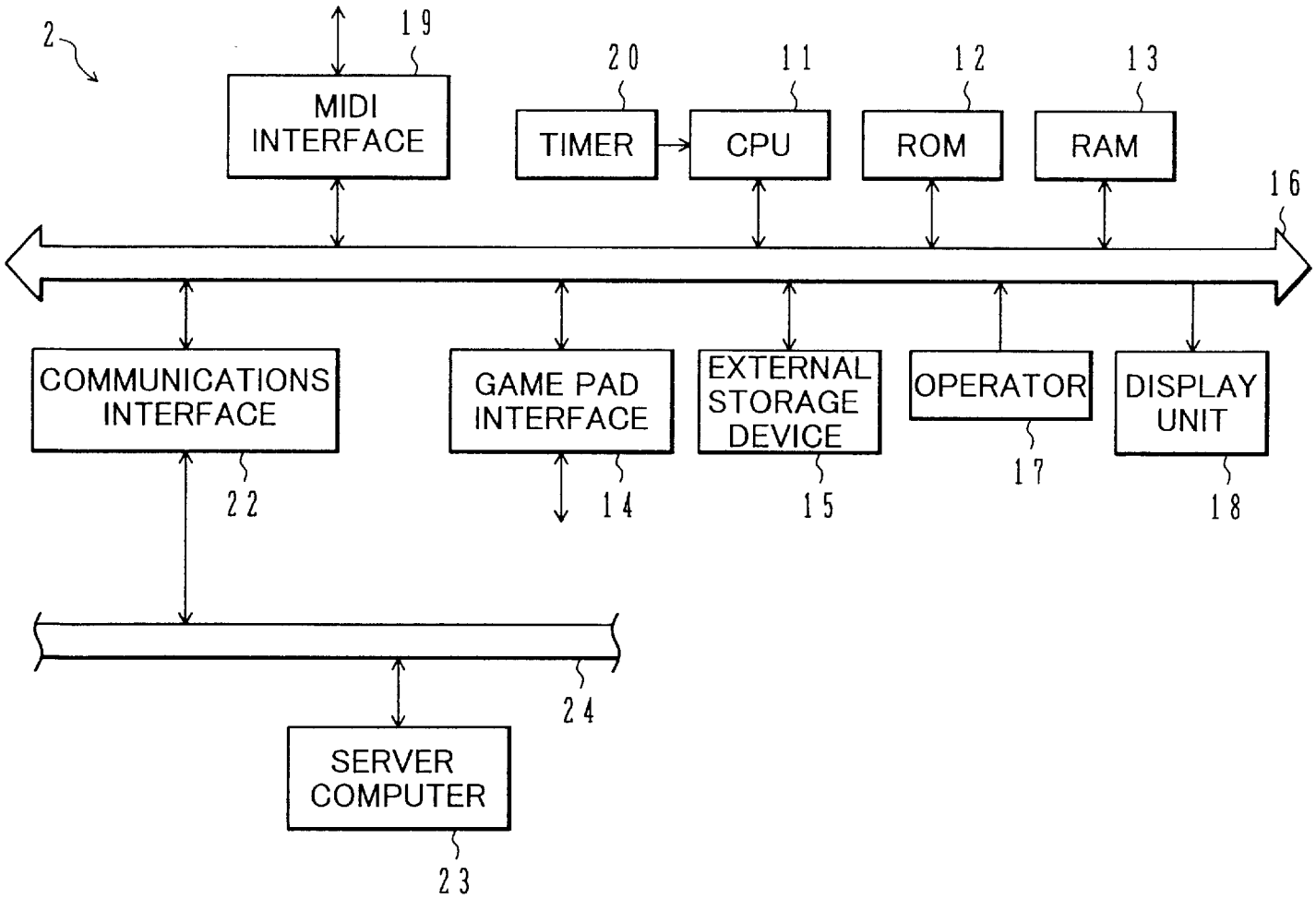
FIG. 4 shows the structure of a computer.

FIG. 4 shows the structure of the computer 2.

Connected to a bus 16 are a CPU 11, a ROM 12, a RAM 13, an external storage device 15, an operator 17, a display unit 18, a game pad interface 14, a MIDI interface 19, and a communications interface 22.

The game pad interface 14 is connected to, for example, three game pads 1*a*, 1*b* and 1*c*. As a user operates upon the game pad 1, the operation information is supplied to the bus 16.

The external storage device 15 may be a hard disk drive, a floppy disk drive, a CD-ROM drive, or the like and may store therein performance data of a plurality of musical pieces. The performance data includes solo performance data and back performance data.

The display unit 18 can display a list of the performance data of a plurality of musical pieces stored in the external storage device 15. A user can select a desired musical piece from the musical piece list with the game pad 1. The display unit 18 can also display setting information of the solo performance, back performance and the like.

As a user selects a desired musical piece, musical instrument and character, the performance data in the external storage device 15 is copied to RAM 13.

An image of musical performance players is displayed on the display unit 18. This image may be a moving image or still image. For example, a plurality of players making a band performance are displayed on the display unit 18. The operation of playing a musical instrument by a player or an image of the player moving on a stage is displayed on the display unit 18.

ROM 12 stores therein computer programs, various parameters and the like. CPU 11 generates musical tone parameters and effect parameters and executes other necessary operations in accordance with the computer programs stored in ROM 12. RAM 13 has a working area for CPU 11, including registers, flags and buffers.

A timer 20 supplies time information to CPU 11 which in accordance with the supplied time information, can perform an interrupt process.

The MIDI interface 19 supplies the musical tone parameters and effect parameters in the MIDI format to the sound generator 3 (FIG. 1). The sound generator 3 may be built in the computer 2.

The external storage device 15 may store therein computer programs and various data such as performance data. If a necessary computer program is not stored in ROM 12, the computer program is stored in the external storage device 15 and read into RAM 13 so that CPU 11 can run this program in the similar manner as if the program is stored in ROM 12. In this case, addition, version-up and the like of a computer program become easy. The external storage device 15 may be a compact disk read-only memory (CD-ROM) drive which can read computer programs and various data stored in a CD-ROM. The read computer programs and various data are stored in a hard disk loaded in a hard disk drive (HDD). Installation, version-up and the like of computer programs become easy. Other types of drives such as a magneto-optical (MO) disk drive may be used as the external storage device 15.

The communications interface 22 is connected to a communications network 24 such as the Internet, a local area network (LAN) and a telephone line, and via the communications network 24 to a server computer 23. If computer programs and various data are not stored in the external storage device 15, these programs and data can be downloaded from the server computer 23. In this case, the client computer 2 transmits a command for downloading a computer program or data to the server computer 23 via the communications interface 22 and communications network 24. A user can transmits this command by using the operator 17. Upon reception of this command, the server computer 23 supplies the requested computer program or data to the client computer 2 via the communications network 24. The computer 2 receives the computer program or data via the communications interface 22 and stores it in the external storage device 15 to complete downloading.

This embodiment may be reduced into practice by a commercially available personal computer installed with computer programs and various data realizing the functions of the embodiment. The computer programs and various data may be supplied to a user in the form of a storage medium such as a CD-ROM and a floppy disk which the personal computer can read. If the personal computer is connected to the communications network such as the Internet, a LAN and a telephone line, the computer programs and various data may be supplied to the personal computer via the communications network.

Figure 5A:
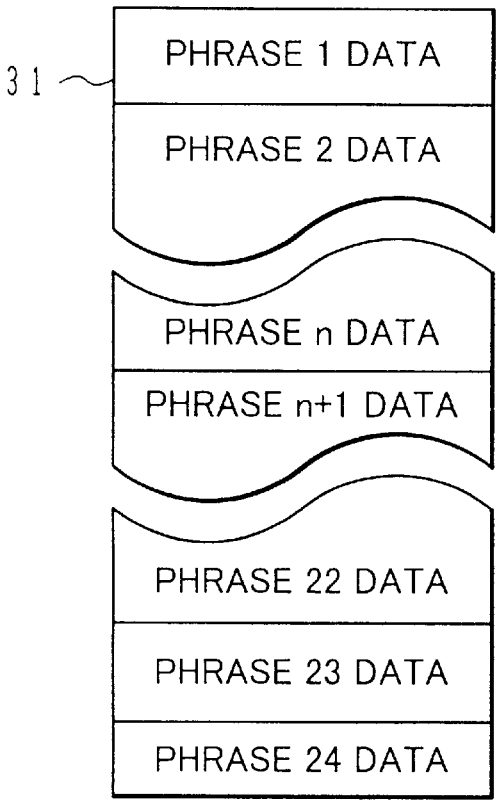
FIG. 5A shows solo performance data.

FIG. 5A shows solo performance data 31 stored in the external storage device or RAM. The solo performance data 31 is prepared for each of musical pieces, musical instruments, and characters. For example, guitar performance data is different from saxophone performance data. The solo performance data 31 has performance data of the phrases "1" to "24".

The solo performance data 31 is stored in the external storage device in the standard MIDI file format. The standard MIDI file format is in conformity with the MIDI specifications. In the standard MIDI file, the performance data 31 is constituted of a pair of event 30*a* and interval 30*b* as shown in FIG. 5C. One phrase is an aggregation of pairs of the event 30*a* and interval 30*b*. For example, the event 30*a* is a note-on event. The interval 30*b* is a time interval from an occurrence of one event to an occurrent of the next event.

Figure 5B:
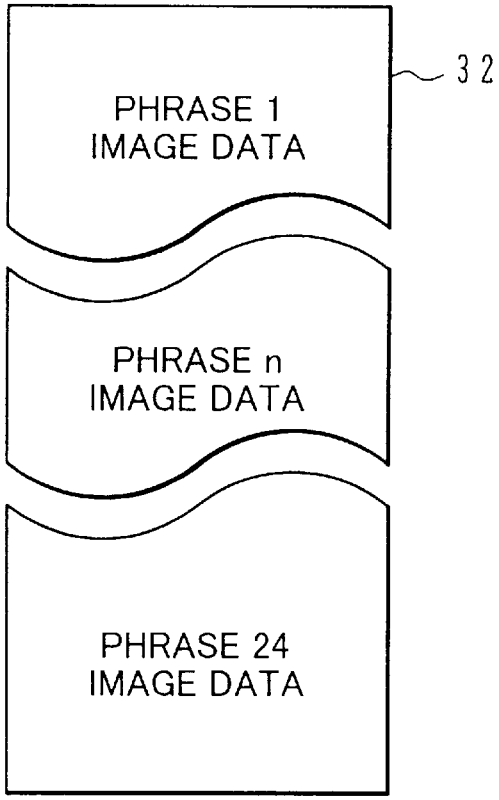
FIG. 5B shows solo performance image data.
Figure 5C:
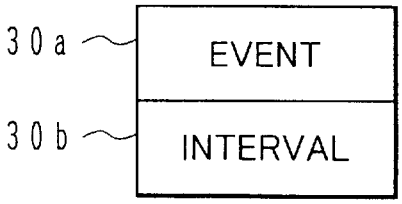
FIG. 5C shows performance data in a standard MIDI file format.

FIG. 5B shows solo image data 32 stored in the external storage device or RAM. The solo image data 32 is prepared for each of musical pieces, musical instruments, and characters. The solo image data 32 has image data of the phrases "1" to "24". The performance data 31 and image data 32 of each phrase have the same reproduction time, and when the start of a phrase is instructed, both the performance data 31 and image data 32 are reproduced generally at the same time.

Figure 6A:
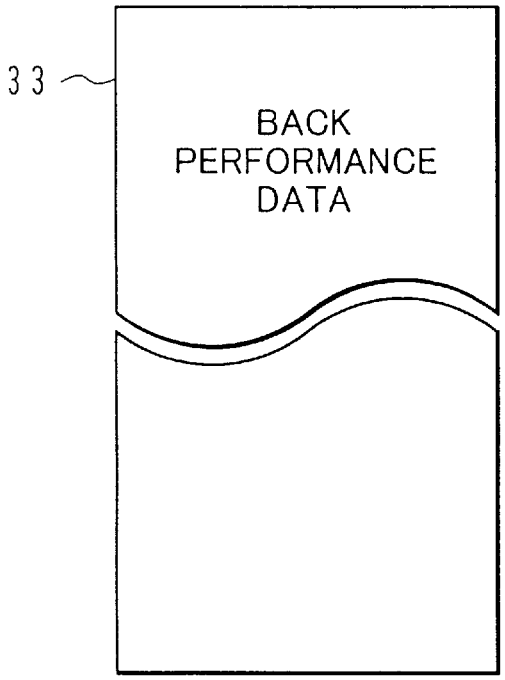
FIG. 6A shows back performance data.

FIG. 6A shows back performance data 33 stored in the external storage device or RAM. The back performance data 33 is prepared for each of musical pieces. A plurality kind of back performance data 33 may be provided for each of musical pieces. The back performance data 33 is not divided into a plurality of phrases, but is the complete data set of a full musical piece continuously and automatically played. The back performance data 33 is also stored in the standard MIDI file format in the external storage device or RAM.

Figure 6B:
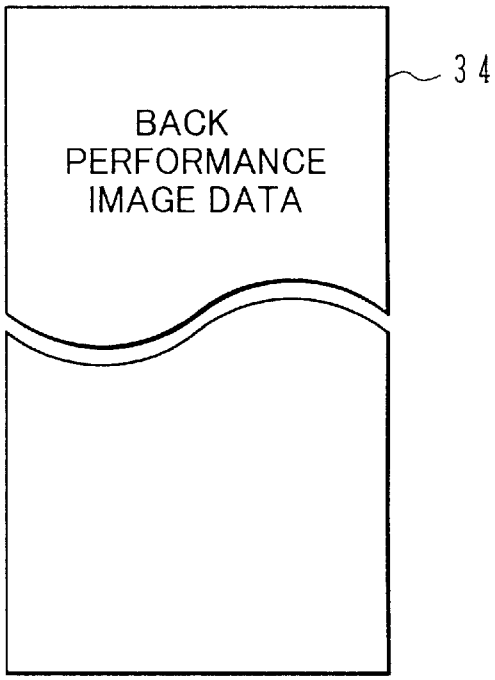
FIG. 6B shows back performance image data.

FIG. 6B shows back performance image data 34 stored in the external storage device or RAM. The back performance image data 34 is the complete image data set of one musical piece, and corresponds to the performance data 33 (FIG. 6A). The back performance image data 34 may be prepared for each of musical pieces or a plurality of back performance image data may be prepared for each of musical pieces.

Figure 7A:
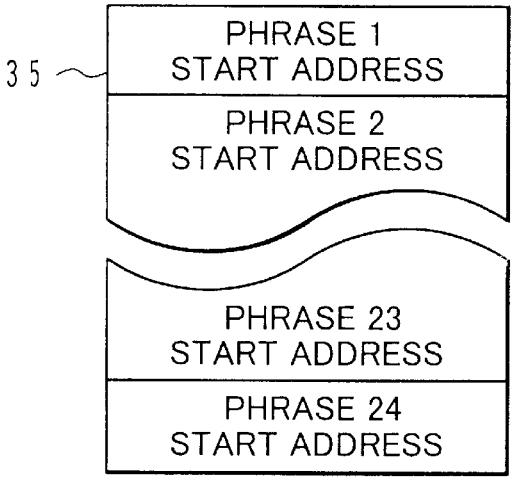
FIG. 7A shows a solo performance data start address group.

FIG. 7A shows a phrase start address group 35 stored in RAM. The solo performance data 31 (FIG. 5A) has the phrases "1" to "24". The start address group 35 contains the start address of each phrase. When a user designates the phrase number, this start address is referred to so that the performance data 31 of the designated phrase shown in FIG. 5A can be read and reproduced.

Figure 7B:
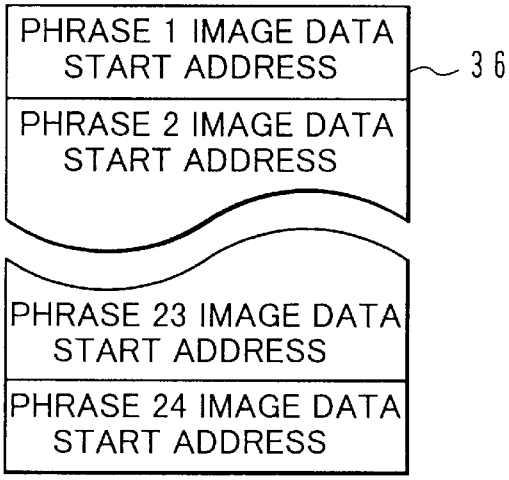
FIG. 7B shows a solo performance image data start address group.

FIG. 7B shows an image data start address group 36 stored in RAM. The solo image data 32 (FIG. 5B) has the phrases "1" to "24". The start address group 36 contains the image data start address of each phrase. When a user designates the phrase number, this start address is referred to so that the image data 32 of the designated phrase shown in FIG. 5B can be read and displayed.

Figure 8A:
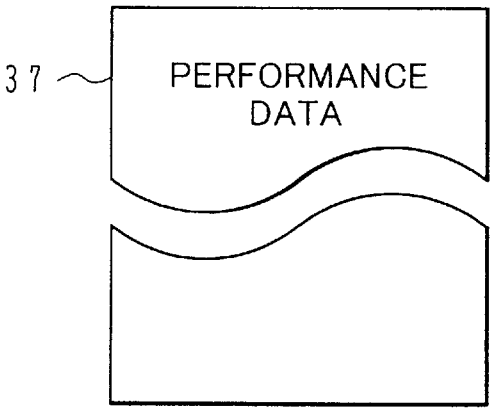
FIG. 8A shows interpolation performance data.

FIG. 8A shows interpolation performance data 37 stored in the external storage device or RAM. The interpolation performance data 37 is performance data for interpolating an intermediate between two phrases when the phrase is to be switched. By using the interpolation performance data 37, one phrase can be switched smoothly to the next phrase. The interpolation performance data 37 is data such as glissando and fill-in. Also for the interpolation performance data 37, a start address group such as shown in FIG. 7A is prepared.

Figure 8B:
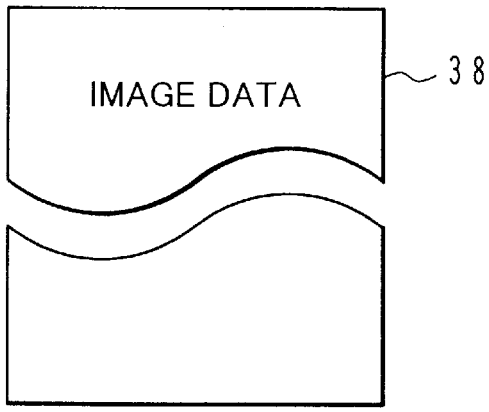
FIG. 8B shows interpolation performance image data.

FIG. 8B shows interpolation image data 38 stored in the external storage device or RAM. The interpolation data 38 is image data for interpolating an intermediate between images for two phrases when the phrase is to be switched. By using the interpolation image data 38, an image for one phrase can be switched smoothly to the image for the next phrase. Also for the interpolation image data 38, a start address group such as shown in FIG. 7B is prepared.

Figure 9:
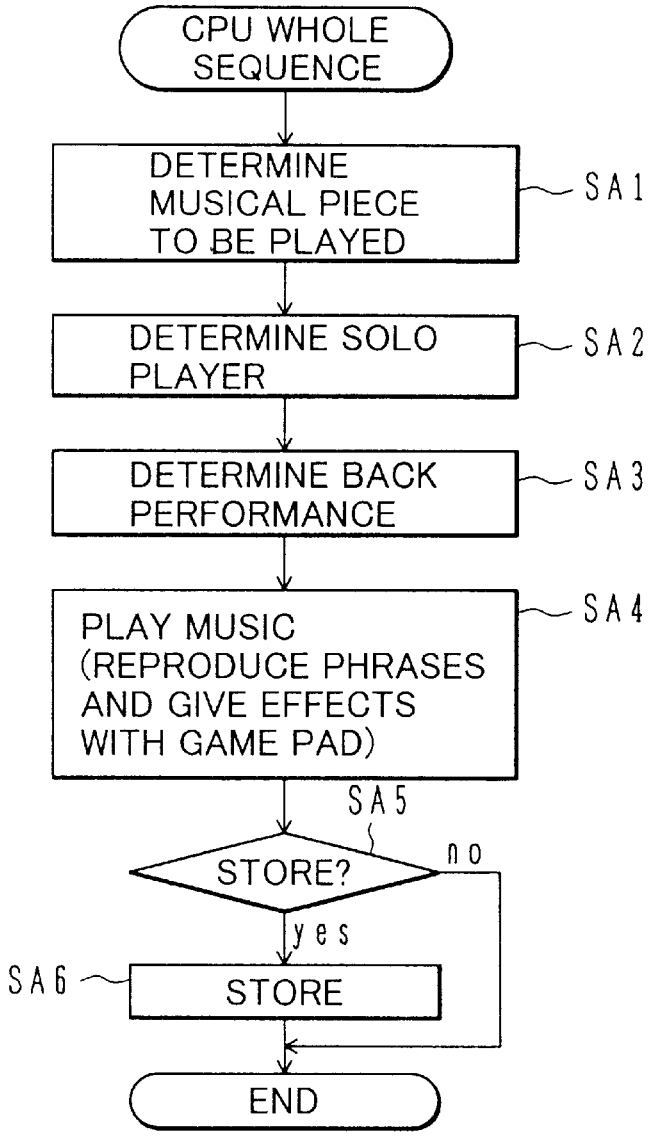
FIG. 9 is a flow chart illustrating the whole sequence to be executed by a CPU.

FIG. 9 is a flow chart illustrating the whole sequence to be executed by CPU.

At Step SA1, a musical piece to be played is determined. A user can select a musical piece with the game pad.

At Step SA2, a solo player is determined. A user can select the solo player with the game pad. If there are a plurality of users, users can select different solo players. The selected solo player is assigned the game pad of the selected user. Determining a solo player includes determining a musical instrument and a character.

At Step SA3, a back performance is determined. When a musical piece is determined at Step SA1, the user can select a desired back performance data for the selected musical piece.

At Step SA4, the musical piece is played. The back performance data is automatically reproduced, and the solo performance data is generated in response to the operations of the user. The user can generate desired phrases of the solo performance with the game pad. In this case, effects such as pitchbend may be given. The details thereof will be later given.

At Step SA5, the user is inquired as to whether the performance data generated by the user is stored or not. If the user wants to store it, a storage process is executed at Step SA6 to terminate the sequence. If the user does not want to store it, the sequence is terminated without storing it. In the storage process at Step SA6, a sequential order of phrases, occurrence (selection) timings of the phrases, effect information and the like are stored in the external storage device.

Figure 10:
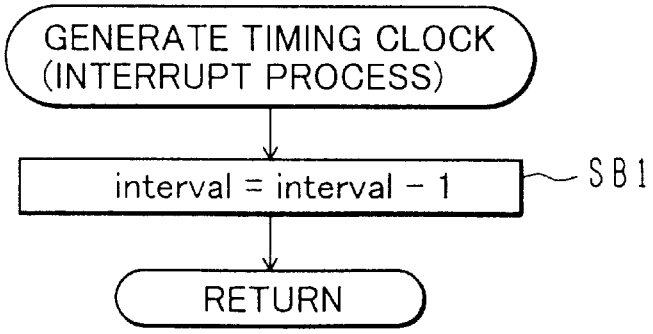
FIG. 10 is a flow chart illustrating an interrupt process.

FIG. 10 is a flow chart illustrating an interrupt process to be executed by CPU. CPU executes an interrupt process at a predetermined time interval in accordance with time information supplied from the timer. With this process, time information is set so as to allow the back performance and solo performance. At Step SB1, the value of a register "interval" is decremented and the flow returns to the process before the interrupt process. The register "interval" stores therein time information corresponding to the interval 30*b* shown in FIG. 5C, and thereafter the value of the register "interval" is decremented at Step SB1. When the value of the register "interval" becomes 0, the next event is processed.

Instead of the time information supplied from the timer, a MIDI clock externally supplied via the MIDI interface or other clocks may be used for activating the interrupt process.

Figure 11:
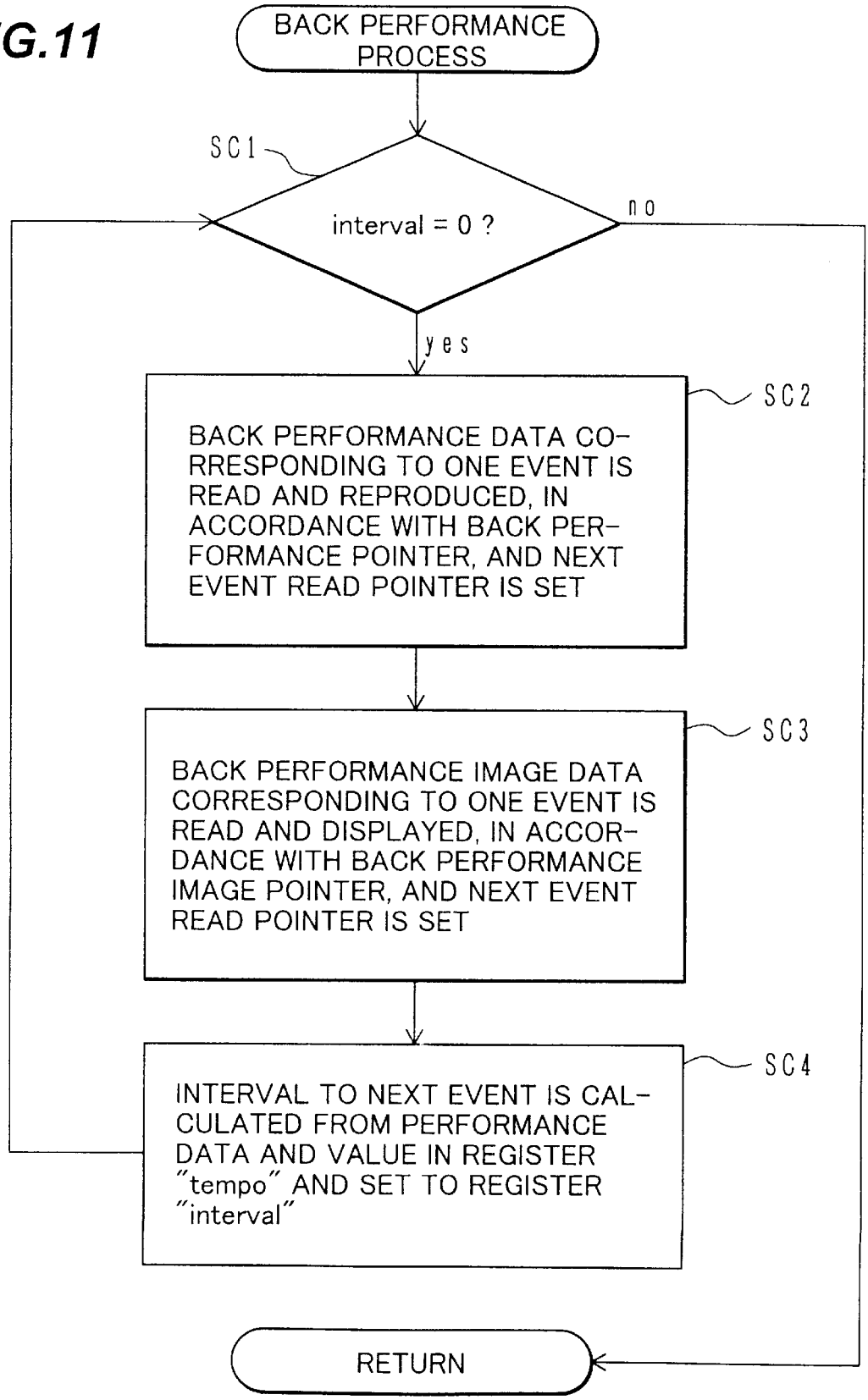
FIG. 11 is a flow chart illustrating a back performance process.

FIG. 11 is a flow chart illustrating a back performance process.

At Step SC1 it is checked whether the register "interval" is 0. If not, it means that it is still not a timing to reproduce the event. Therefore, the flow advances along a NO arrow to terminate the process.

If the register "interval" is 0, it means that it is a timing to reproduce the event, and the flow advances along a YES arrow to Step SC2.

At Step SC2, in accordance with a back performance current pointer (read pointer), the back performance data 33 (FIG. 6A) corresponding to one event is read and reproduced. Specifically, the performance data 33 is supplied to the sound generator and reproduced from the speaker. In succession, the read pointer is set with the address of the next event.

At Step SC3, in accordance with a back performance image pointer (read pointer), the back performance data 34 (FIG. 6B) corresponding to one event is read and displayed on the display unit. In succession, the read pointer is set with the address of the next image data event.

At Step SC4, a new interval is calculated from the interval 30*b* (FIG. 5C) and a register "tempo" and the calculated interval is set to the register "interval". The interval 30*b* indicates a time duration from the current event to the next event. The register "tempo" stores therein a tempo value of a musical piece, the tempo value being able to be changed by using the game pad. Thereafter, the flow returns to Step SC1 to repeat the above process.

Figure 12:
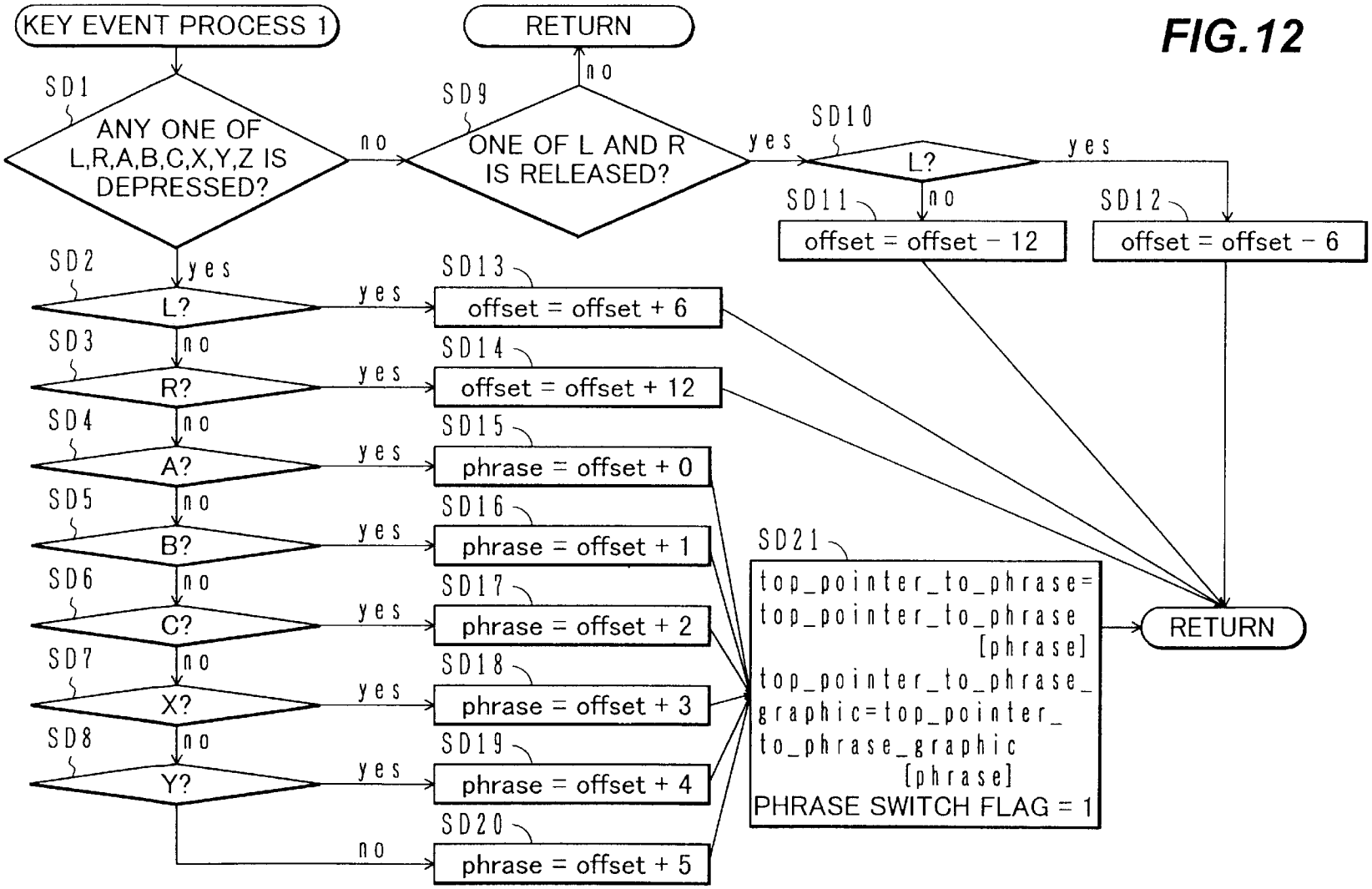
FIG. 12 is a flow chart illustrating a first key event process.

FIG. 12 is a flow chart illustrating the first key event process. This process determines the phrase numbers "1" to "24" in Table 1, in accordance with the manipulation of the game pad. In accordance with the entered phrase number "1" to "24", "0" to "23" is stored in a register "phrase", i.e., the number of "phrase number—1" is stored in the register "phrase".

At Step SD1, it is checked which one among "L, R, A, B, C, X, Y, and Z" is depressed. If any one of them is depressed, the flow advances along a YES arrow to Step SD2.

At SD2 it is checked whether the button "L" is depressed. If depressed, at Step SD13 the value of a register "offset" is incremented by "6" to terminate the process. Namely, if the button "L" is depressed, it means that the phrases "7" to "12" can be selected. The initial value of the register "offset" is "0".

If the button "L" is not depressed, it is checked at Step SD3 whether the button "R" is depressed. If depressed, at Step SD14 the value of a register "offset" is incremented by "12" to terminate the process. Namely, if the button "R" is depressed, it means that the phrases "13" to "18" can be selected. If both the buttons "L" and "R" are depressed, first "6" is added and then "12" is added, which means that the phrases "19" to "24" can be selected.

If the button "R" is not depressed, it is checked at Step SD4 whether the button "A" is depressed. If depressed, a value of the register "offset" added with "0" is set to a register "phrase" at Step SD15 and the flow advances to Step SD21.

If the button "A" is not depressed, it is checked at Step SD5 whether the button "B" is depressed. If depressed, a value of the register "offset" added with "1" is set to the register "phrase" at Step SD16 and the flow advances to Step SD21.

If the button "B" is not depressed, it is checked at Step SD6 whether the button "C" is depressed. If depressed, a value of the register "offset" added with "2" is set to the register "phrase" at Step SD17 and the flow advances to Step SD21.

If the button "C" is not depressed, it is checked at Step SD7 whether the button "X" is depressed. If depressed, a value of the register "offset" added with "3" is set to the register "phrase" at Step SD18 and the flow advances to Step SD21.

If the button "X" is not depressed, it is checked at Step SD8 whether the button "Y" is depressed. If depressed, a value of the register "offset" added with "4" is set to the register "phrase" at Step SD19 and the flow advances to Step SD21.

If the button "Y" is not depressed, it means that the button "Z" was depressed. Therefore, a value of the register "offset" added with "5" is set to the register "phrase" at Step SD20 and the flow advances to Step SD21.

At Step SD21, the solo performance data start address 35 (FIG. 7A) having the phrase number indicated by the register "phrase" is read and set to a pointer "top_pointer_to_phrase".

Next, the solo image data start address 36 (FIG. 7B) having the phrase number indicated by the register "phrase" is read and set to a pointer "top_pointer_to_phrase_graphic".

Next, a phrase switch flag is set to "1". This flag indicates whether a phrase switch was designated or not. Thereafter, the process is terminated.

If at Step SD1 none of the buttons L, R, A, B, C, X, Y, Z are not depressed, the flow advances along a NO arrow to Step SD9.

It is checked at Step SD9 whether any one of the buttons L and R is released. If not released, the flow advances along a NO arrow to terminate the process, whereas if released, the flow advances along a YES arrow to Step SD10.

It is checked at Step SD10 whether the button "L" is released. If released, the flow advances along a YES arrow to Step SD12 whereat the register "offset" is subtracted by "6" to terminate the process, whereas if not released, it means that the button "R" was released. Therefore, the flow advances along a NO arrow to Step SD11 whereat the register "offset" is subtracted by "12" to terminate the process.

With the above operations, the phrase number is stored in the register "phrase" and the read pointers to the performance data and image data are set.

Figure 13:
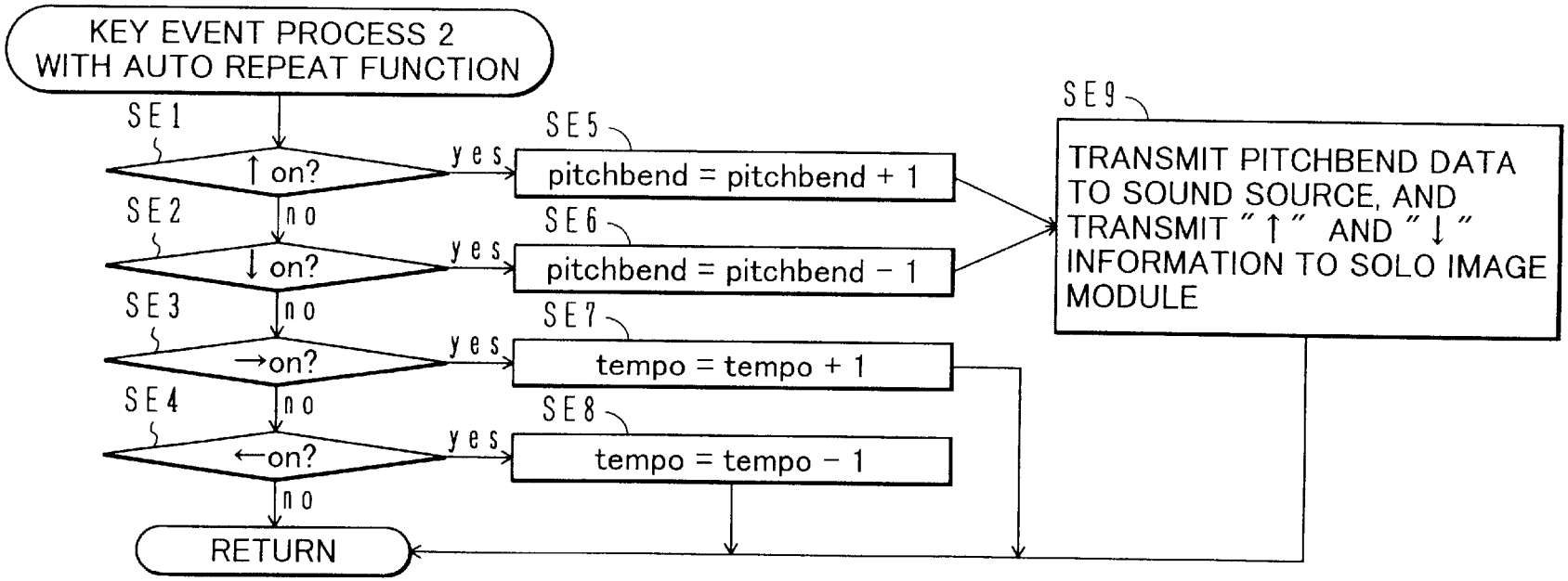
FIG. 13 is a flow chart illustrating a second key event process.

FIG. 13 is a flow chart illustrating the second key event process. This process gives a musical tone with effects shown in Table 2, in accordance with the manipulation of the game pad. A register "pitchbend" stores a pitchbend value, and a register "tempo" stores the tempo value.

At Step SE1, it is checked whether the key "↑" is on. If on, it means that raising the pitchbend was designated, so that the value of the register "pitchbend" is incremented at Step SE5 and the flow advances to Step SE9.

At Step SE2, it is checked whether the key "↓" is on. If on, it means that lowering the pitchbend was designated, so that the value of the register "pitchbend" is decremented at Step SE6 and the flow advances to Step SE9.

At Step SE9, the value of the register "pitchbend" is transmitted to the sound generator as pitchbend data, and information on which of the keys "↑" and "↓" was turned on is transmitted to a display process solo image module. The sound generator generates a musical tone signal in accordance with the pitchbend data, and the display unit displays an image in accordance wit the pitchbend data. Thereafter, the process is terminated.

At Step SE3, it is checked whether the key "→" is on. If on, it means that raising the tempo was designated, so that the value of the register "tempo" is incremented at Step SE7 and the process is terminated.

At Step SE4, it is checked whether the key "←" is on. If on, it means that lowering the tempo was designated, so that the value of the register "tempo" is decremented at Step SE8 and the process is terminated.

The value of the register "tempo" is a tempo value for the back performance and solo performance. The tempo value of the back performance is used at Step SC4 shown in FIG. 11, and the tempo value of the solo performance is used at Step SF6 shown in FIG. 14 to be later described.

The manipulation of the direction key includes an auto repeat function. Namely, if a user continues to depress this key, the corresponding process described above is repeated so that the pitchbend value or tempo value continues to be changed.

A change in the pitchbend value or tempo value is not limited only to a change by one step, but it may be two or more steps.

FIG. 14 is a flow chart illustrating the solo performance process.

At Step SF1, it is checked whether a phrase switch flag is "1" or not. As a user instructs a phrase switch, the phrase switch flag is set to "1" at Step SD21 shown in FIG. 12. If this flag is "1", the flow advances along a YES arrow to Step SF8.

At Step SF8, current image data now under display is compared with image data indicated by the pointer "top_pointer_to_phrase_graphic", i.e., image data after switching is compared with image data before switching. This pointer "top_pointer_to_phrase_graphic" was set at Step SD21 shown in FIG. 21 as a read pointer for switching. Thereafter, the flow advances to Step SF9.

Since there is no phrase before switching at the start of performance, Steps SF8 and SF9 are bypassed and Step SF10 starts.

At Step SF9 it is checked whether continuous reproduction is possible. For example, if image data before switching differs greatly from image data after switching, a switch between images becomes unnatural so that it is judged that continuous reproduction is impossible and the flow advances to Step SF11 at which interpolation is performed. On the other hand, if there is no large difference between image data, it is judged that continuous reproduction is possible, and the flow advances to Step SF10. Whether continuous reproduction is possible or not may be judged from performance data.

At Step SF10, the pointer "top_pointer_to_phrase" is set as the solo performance read pointer, and the pointer "top_pointer_to_phrase_graphic" is set as the solo performance image read pointer. These pointers were already determined at Step SD21 shown in FIG. 12. Next, the phrase switch flag is set to "0" to record a completion of the phrase switch process. Thereafter, the process advances to Step SF4.

At Step SF4, in accordance with the solo performance read pointer, the solo performance data 31 (FIG. 5A) corresponding to one event is read and reproduced. Namely, the performance data 31 is supplied to the sound source and reproduced from the speaker. In succession, an address of the next event is set to the read pointer. Since the next event does not exist upon completion of phrases, an end mark is set to the read pointer.

At Step SF5, in accordance with the solo performance image read pointer, the solo performance image data 32 (FIG. 5B) corresponding to one event is read and displayed on the display unit. In succession, an address of the next image data event is set to the read pointer. Since the next event does not exist upon completion of phrases, an end mark is set to the read pointer.

At Step SF6, a new interval is calculated from the interval 30*b* (FIG. 5C) and the register "tempo" and the calculated interval is set to the register "interval". The interval 30*b* indicates a time duration from the current event to the next event. Although the register "interval" is provided for each of the back performance and solo performance, both the registers are collectively represented by the register "interval" in this specification for the simplicity of description. The register "tempo" stores therein a tempo value of a musical piece, the tempo value being able to be changed by using the game pad. If one user changes the tempo, the tempo of only the solo performance to be made by the user may be changed, or the tempos of all solo performance parts may be changed. Thereafter, the flow returns to Step SF1.

If it is judged at Step SF9 that the continuous reproduction is not possible, the flow advances to Step SF11 to perform an interpolation step.

It is checked at Step SF11 whether interpolation is being executed presently, i.e., whether interpolation performance data or interpolation image data is being reproduced. If not, the flow advances along a NO arrow to Step SF12, whereas if under interpolation, the flow advances along a YES arrow to Step SF15.

At Step SF12, on the basis of an error code indicating an inability of continuous reproduction, an interpolation image data pointer (start address) and an interpolation performance data pointer (start address) are acquired.

At Step SF13, an address indicated by the interpolation performance data pointer is set to the solo performance read pointer, and an address indicated by the interpolation image data pointer is set to the solo performance image read pointer.

At Step SF14, an interpolation flag is set to "1". By referring to this interpolation flag, it is possible to execute Step SF11 which checks whether interpolation is being executed presently. Thereafter, the flow advances to Step SF4 to perform the operations described above.

If it is judged at Step SF11 that interpolation is being executed, the flow advances to Step SF15.

At Step SF15 it is checked whether the interpolation is completed. If all interpolation data is completely read, it means that the interpolation is completed. If the interpolation is not still completed, the flow advances to Step SF4 to execute the already described operations, whereas if the interpolation is completed, the interpolation flat is cleared to "0" at Step SF16 to thereafter return to Step SF1.

If it is judged at Step SF1 that the phrase switch flag is "0", it means that the phrase switching is not being performed, and the flow advances to Step SF2.

At Step SF2 it is checked whether the register "interval" is "0". If not, it means that it is not a timing to reproduce the event, so that the flow advances along a NO arrow to return to Step SF1.

If the register "interval" is "0", it means that it is a timing to reproduce the event, so that the flow advances along a YES arrow to Step SF3.

It is checked at Step SF3 whether the current phrase is completed. If not, the flow advances along a NO arrow to Step SF4 to perform the already described operations, whereas if completed, the flow advances along an YES arrow to Step SF7.

It is checked at Step SF7 whether the musical piece is completed. If not, the flow advances along a NO arrow to return to Step SF1, whereas if completed, the flow advances along a YES arrow to terminate the process.

In this embodiment, users can improvise musical performance with ease only by selectively switching between phrases with game pads. As compared with musical performance with a keyboard, musical performance with a game pad is simpler.

Without any knowledge and techniques of musical instruments and music, a user can make solo performance or play in concert with ease only by controlling timings of depressing buttons of a game pad.

Since a back performance is automatically made, a user can play in concert easily by using a game pad. A plurality of users can also play in concert by using a plurality of game pads.

A musical instrument keyboard or computer keyboard may also be used in place of a game pad. Also in this case, a user selects only phrases in order to play a musical piece.

A sound reproduction button may be used to reproduce a pattern (performance data) while the button is depressed and stop the reproduction when the button is released. With addition of the sound reproduction button, performance rich in variations becomes possible. When the sound reproduction button is again depressed after it was released, the pattern may start from a part when the button was released, or may start from the beginning thereof. Selection between these two operations may be determined through software or hardware settings, or another button may be used to switch between these two operations as desired. In this manner, performance richer in variations becomes possible. The sound reproduction button may be used in common as an operation selection switch.

The present invention has been described in connection with the preferred embodiments. The invention is not limited only to the above embodiments. It is apparent that various modifications, improvements, combinations, and the like can be made by those skilled in the art.

What is claimed is:

1. A method of generating a musical tone signal, comprising the steps of:

(a) selecting one of a plurality of phrases in response to a combination of simultaneous manipulations of phrase select operators by a user; and (b) reading performance data of the selected phrase from performance data pre-stored by phrase and generating musical tone signals of the read performance data in response to said manipulations.

2. A method according to claim 1, further comprising the step of:

(c) reading image data of the selected phrase from image data pre-stored by phrase and generating an image signal.

3. A method according to claim 1, further comprising the step of:

(c) reading back performance data in response to manipulation of a performance start operator independently from manipulation of the phrase select operator and generating a back performance musical tone signal.

4. A method according to claim 1, further comprising the step of:

(c) generating an effect assigning signal in response to manipulation of an effect operator, the effect assigning signal assigning the musical tone signal with musical effects.

5. A method according to claim 4, further comprising the step of:

(d) storing information on manipulation of the effect operator at said step (c).

6. A method according to claim 1, further comprising the step of:

(c) reading interpolation performance data and generating a musical tone signal, on a basis of a connection state between a lastly selected phrase and a currently selected phrase.

7. A method according to claim 1, further comprising the step of:

(c) storing a sequential order of phrases selected at said step (a).

8. A method according to claim 7, wherein said step (c) stores a sequential order and select timings of phrases selected at the said step (a).

9. A method according to claim 1, wherein said step (b) reads performance data having a different performance style in response to manipulation of the phrase select operator.

10. A method according to claim 1, wherein said step (b) starts reading performance data in response to manipulation of the phrase select operator.

11. A method according to claim 10, wherein said step (b) starts or stops reading performance data in response to manipulation of the phrase select operator.

12. A method according to claim 11, wherein said step (b) starts reading the performance data of a previous phrase again from a point of an interruption when same phrase is selected successively.

13. A method according to claim 11, wherein said step (b) starts reading the performance data of the selected phrase from a start thereof.

14. A method according to claim 1, further comprising the step of:

(c) selecting a musical instrument before said step (b), in response to manipulation of a musical instrument select operator, wherein said step (b) reads performance data different for each selected musical instrument and generates the musical tone signal.

15. A method according to claim 1, further comprising the step of:

(c) selecting a performance character before said step (b), in response to manipulation of a character select operator, wherein said step (b) reads performance data different for each selected character and generates the musical tone signal.

16. A method according to claim 1, wherein a number of said performance data pre-stored by phrase is greater than a number of said phrase select operators.

17. A storage medium storing a program to be executed by a computer, the program comprising the instructions for:

(a) selecting one of a plurality of phrases in response to a combination of simultaneous manipulations of phrase select operators by a user; and (b) reading performance data of the selected phrase from performance data pre-stored by phrase and generating musical tone signals of the read performance data in response to said manipulations.

18. An apparatus for generating a musical tone signal comprising:

a memory for storing performance data by phrase;

a selector for selecting one of a plurality of phrases in response to a combination of simultaneous manipulations of phrase select operators by a player; and a generator for generating musical tone signals of the read performance data in response to said manipulations by reading performance data of the selected phrase from said memory.

19. An apparatus for generating a musical tone signal comprising:

means for storing performance data by phrase;

means for selecting one of a plurality of phrases in response to a combination of simultaneous manipulations of phrase select operators by a player; and means for generating musical tone signals of the read performance data in response to said manipulations by reading performance data of the selected phrase from said storing means.

20. An apparatus according to claim 19, wherein said storing means stores image data by phrase, and the apparatus further comprises means for reading image data of the selected phrase from said storing means and generating an image signal.

21. An apparatus according to claim 19, wherein said storing stores back performance data and the apparatus further comprising means for reading the back performance data from said storing means in response to manipulation of a performance start operator independently from manipulation of the phrase select operator and generating a back performance musical tone signal.

22. An apparatus according to claim 19, further comprising means for generating an effect assigning signal in response to manipulation of an effect operator, the effect assigning signal assigning the musical tone signal with musical effects.

23. An apparatus according to claim 22, further comprising means for storing information on manipulation of the effect operator.

24. An apparatus according to claim 19, wherein said storing means stores interpolation performance data and the apparatus further comprises means for reading the interpolation performance data from said storing means and generating a musical tone signal, on a basis of a connection state between a lastly selected phrase and a currently selected phrase.

25. An apparatus according to claim 19, further comprising means for storing a sequential order of phrases selected by said selecting means.

26. An apparatus according to claim 25, wherein said storing means stores a sequential order and select timings of phrases selected by said selecting means.

27. An apparatus according to claim 19, wherein said storing means stores performance data of a plurality of phrases each having a different performance style.

28. An apparatus according to claim 19, wherein said musical tone signal generating means starts reading performance data in response to manipulation of the phrase select operator.

29. An apparatus according to claim 28, wherein said musical tone signal generating means starts or stops reading performance data in response to manipulation of the phrase select operator.

30. An apparatus according to claim 29, wherein said musical tone signal generating means starts reading the performance data of a previous phrase again from a point of an interruption when same phrase is selected successively.

31. An apparatus according to claim 29, wherein said musical tone signal generating means starts reading the performance data of the selected phrase from a start thereof.

32. An apparatus according to claim 19, further comprising means for selecting a musical instrument in response to manipulation of a musical instrument select operator, wherein said musical tone signal generating means reads performance data different for each selected musical instrument and generates the musical tone signal.

33. An apparatus according to claim 19, further comprising means for selecting a performance character in response to manipulation of a character select operator, wherein said musical signal generating means reads performance data different for each selected character and generates the musical tone signal.

34. An apparatus according to claim 19, wherein a number of said performance data pre-stored by phrase is greater than a number of said phrase selecting means.

* * * * *